US009695651B2

(12) United States Patent
Gorrara et al.

(10) Patent No.: US 9,695,651 B2
(45) Date of Patent: Jul. 4, 2017

(54) APPARATUS AND METHOD FOR USE IN SLIM HOLE WELLS

(71) Applicant: SCHLUMBERGER TECHNOLOGY CORPORATION, Sugar Land, TX (US)

(72) Inventors: Andrew John Joseph Gorrara, Stonehaven (GB); Daniel O'Brien, Stonehaven (GB); Peter Wood, Hatton of Fintry (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 913 days.

(21) Appl. No.: 13/927,390

(22) Filed: Jun. 26, 2013

(65) Prior Publication Data

US 2014/0000911 A1 Jan. 2, 2014

(30) Foreign Application Priority Data

Jul. 2, 2012 (GB) ..... 1211716.4

(51) Int. Cl.
*E21B 43/10* (2006.01)
*E21B 19/16* (2006.01)

(52) U.S. Cl.
CPC ..... *E21B 19/16* (2013.01); *E21B 43/106* (2013.01); *E21B 43/108* (2013.01)

(58) Field of Classification Search
CPC ..... E21B 19/16; E21B 43/108; E21B 43/106; E21B 17/02; E21B 33/128
See application file for complete search history.

(56) References Cited

U.S. PATENT DOCUMENTS 4,817,716 A * 4/1989 Taylor ..... E21B 17/02 166/207
4,869,319 A 9/1989 Szymozak et al.
(Continued)

FOREIGN PATENT DOCUMENTS

EP 2013445 B1 10/2011
GB 2345308 A 7/2000
(Continued)

OTHER PUBLICATIONS http://www.teamoiltools.com/content/documents/product_data_sheets/02_Completion_Tools/Accessories/T585_TEAM_PBR_BE_web.pdf Accessed Oct. 12, 2016.*
(Continued)

*Primary Examiner* — Robert E Fuller
*Assistant Examiner* — David Carroll
(74) *Attorney, Agent, or Firm* — Jeffery R. Peterson; Jesse D. Lambert

(57) ABSTRACT

An apparatus and method for providing a tubular connection in the form of a liner tieback connection or a liner hanger in a slim hole well as found in deep wells. When installing the casing sections, a first casing section having a profiled surface distinct from a surface of an adjacent casing section is provided. A liner is run into the first casing section and a part of a portion is radially expanded to morph against the inner surface of the first casing section at the profiled surface and form a sealed joint. Various arrangements of profiled surfaces are provided. The liner may also have a profiled surface. By adapting the casing section to receive the liner directly, a slim hole well construction is achieved.

19 Claims, 5 Drawing Sheets

(56) References Cited

U.S. PATENT DOCUMENTS

| | | | | |
|---|---|---|---|---|
| 5,355,968 | A | 10/1994 | Smith | |
| 6,702,029 | B2 | 3/2004 | Metcalfe et al. | |
| 7,017,670 | B2 | 3/2006 | Hazel et al. | |
| 8,291,986 | B2 | 10/2012 | Gorrara et al. | |
| 2002/0195252 | A1 | 12/2002 | Maguire et al. | |
| 2004/0020659 | A1* | 2/2004 | Hall | E21B 17/003 166/380 |
| 2004/0031530 | A1* | 2/2004 | Duggan | E21B 17/18 138/98 |
| 2004/0031613 | A1* | 2/2004 | Martin | E21B 37/04 166/311 |
| 2004/0159445 | A1* | 8/2004 | Hazel | E21B 29/10 166/382 |
| 2005/0000697 | A1* | 1/2005 | Abercrombie Simpson | E21B 17/22 166/380 |
| 2005/0161226 | A1 | 7/2005 | Duggan et al. | |
| 2006/0213671 | A1* | 9/2006 | Li | E21B 43/045 166/387 |
| 2007/0158081 | A1 | 7/2007 | Harrall et al. | |
| 2009/0266560 | A1 | 10/2009 | Ring et al. | |
| 2010/0078178 | A1 | 4/2010 | Watson | |
| 2012/0227984 | A1 | 9/2012 | Thomson | |

FOREIGN PATENT DOCUMENTS

| | | |
|---|---|---|
| GB | 2474692 | 4/2011 |
| WO | WO 02/059452 A1 | 8/2002 |
| WO | WO 2004/099562 A1 | 11/2004 |
| WO | WO 2011/048426 A2 | 4/2011 |

OTHER PUBLICATIONS http://canwayenterprises.com/products/completion-tools/polished-bore-receptacle/ Accessed Oct. 12, 2016.*
Schlumberger Oilfield Glossary Accessed Oct. 12, 2016.*

* cited by examiner 300
400
416
404c
416
314

300
400
404c
314

300
308
320
318
400
404
316
322
322

300
3
404
400
318
408
316
322
320
308
306

300
400
324
318
322
320
306
404

404
300
400
324
318
322
326
320

300
310
400
404
304

300
310
304
306
404
306
400

APPARATUS AND METHOD FOR USE IN SLIM HOLE WELLS

FIELD OF THE INVENTION

The present invention relates to an apparatus and a method for connecting tubular members in a wellbore and more particularly, though not exclusively, to an apparatus and a method for providing a tieback connection in a slim hole well.

BACKGROUND TO THE INVENTION

Wellbores are typically formed by drilling a borehole to a first pre-determined depth and then lining the borehole with a steel casing. Typically, a number of sections of casing of decreasing diameter are used. A first section of casing is lowered into the wellbore and hung from the surface after the well has been drilled to a first designated depth. Cement is then circulated in the annulus between the outer wall of the casing and the borehole. The well is then drilled to a second designated depth and a second section of casing having a smaller diameter is run into the well. This process is typically repeated with additional casing sections of decreasing diameter until the well has been drilled to the total required depth.

According to one solution, the second section may be sufficiently long to extend to a wellhead and be "hung off" in the wellhead at surface. Once "hung off", the second casing section is then cemented in the same manner as the first section. In some instances engineers prefer this solution to maintain well integrity. However, in certain environments, such as for example, in deepwater environments, long casing is often too heavy to risk as a single deployment. Also, Equivalent Circulating Density (ECD) with a long string can be too high causing the potential for circulation loss zones. Also, the annulus between the drillstring and the casing during drilling is relatively narrow all the way between the drilling assembly downhole and the wellhead meaning that higher pressure is needed to pump the drilling fluid through the annulus back to surface. Such high pressures may be high enough to cause the drilling mud to be pumped into the formation being drilled and thus cause damage or even destruction to the reservoir.

According to an alternative solution, the second section is fixed at a depth such that the upper portion of the second section overlaps the lower portion of the first section of casing. In this example, the casing which does not extend to surface is referred to as a "liner". The liner section is then fixed to the first casing section, such as by using a device called a liner hanger. The liner section is then cemented in the same manner as the first casing section. As well design becomes more challenging, due to longer step outs and deeper targets, and reservoirs become depleted, there are more reasons to design well construction with critical casing strings run as liners. Also, in most wells, the use of liners mitigates the high mud pressure problem associated with the use of the long casing because when the liners are used, the annulus is relatively narrow only within the liner and becomes wider within the casing above the liner.

After the well has been drilled, it may be necessary to connect the liner string back to the surface (or a point higher up in the well). In this case, a string of casing is sealingly connected to the top of the liner section and runs all the way back to surface so that the liner is "tied back" to the surface (or a point higher in the well between the surface and the liner hanger).

The area above the production zone of the well is typically sealed using packers inside the casing or liner and connected to the surface via smaller diameter production tubing. This provides a redundant barrier to leaks, and allows damaged sections to be replaced. Also, the smaller diameter of the production tubing increases the velocity of the oil and gas. The natural pressure of the subsurface reservoir may be high enough for the oil or gas to flow to the surface. When this is not sufficient, such as for older wells, installing smaller diameter tubing may help the production, but artificial lift methods, such as gas lift, may also be needed. The well needs to be configured to receive the artificial lift apparatus.

Known methods for sealingly connecting a tie-back string of casing into a downhole liner section typically involve the use of a tool known as a polished bore receptacle (PBR). The PBR is a separate tool which is screwed to the top of the liner section. The PBR has a smoothed cylindrical inner bore configured to receive the lower end of the tieback casing. The tieback casing is landed in the PBR to form a sealed connection between the tieback casing and the liner. The lower portion of the tieback casing is configured with seals on its outer diameter and these seals seal within the PBR.

FIG. 1 shows a known method of providing liner tieback connection in a wellbore 100 in which a second tube 10 is tied back to the surface using a first tube 12. The wellbore 100 is dined with a casing 102 which incrementally decreases in diameter as the depth increases. Tubing 104 for gas lift, with an internal gas lift valve 106, is provided within the casing 102. The second tube 10 has a diameter of 9⅝ in (244 mm) and extends upwards into the upper adjacent casing which has a diameter of 13⅜ in (340 mm). A PBR 14 is connected to the upper end of the second tube 10. A liner hanger 16 at an upper portion, and cement 108 at a lower portion, fix the second tube 10 within the wellbore 100. The first tube 12 is lowered and the lower end of the first tube 12 fits within the polished bore of the PBR 14. By itself, particularly in harsh environments, the PBR 14 may not be able to provide sufficient sealing and so a tie back packer 18 can be provided above the joint of the first and second tubes. The slidable sealing provided by the PBR 14 does not assist with supporting the first tube 12 in the wellbore 100 and so an anchor 20 may also be provided.

A major disadvantage of this known tieback connection is that the majority of the inside length of the PBR is exposed and is susceptible to damage as other downhole tools are run into the wellbore. A downhole tool being run through the PBR may impact the polished inside surface of the PBR on its way downhole. This can cause damage that reduces the sealing ability of the PBR. Also, drilling debris can degrade the PBR sealing surfaces. In addition, it is known that associated components, such as tie back stingers, seal stems and packers can leak, particularly in harsh environments. Furthermore, the PBR allows for thermal expansion and contraction of the tieback liner longitudinally, during which the liner seals can move up and down in the PBR. Over time this movement can cause the seals to wear and ultimately to fail. This is regarded to be one of the major limitations of a conventional PBR. A conventional seal stem relies on elastomeric seals to create the seal between the tie-back string and the liner within the PBR. Elastomeric seals are prone to damage during deployment and are inherently prone to wear over time and thus cannot be relied upon to last the life of well. In addition they will be worn due to relative movement when the well temperature changes during production and shut in cycles. Hence, elastomeric seals are no longer considered suitable for a well barrier in some areas. Still furthermore, the PBR is generally short (3-4 m) causing spacing out of the tieback string to be sometimes difficult to achieve successfully first time. In deep wells, especially subsea wellheads, this can have a substantial time and cost implication. It is usually not possible to lengthen the PBR due to the design of the liner hanger system. A PBR is prone to damage and a relatively minor score may compromise the seal. Furthermore, the use of elastomeric seals in the well barrier envelope is not allowed in certain places, e.g. in the Norwegian sector of the North Sea. For the above reasons, engineers sometimes prefer to run a long casing string.

The applicant has appreciated the need for an alternative means of connecting to a liner which eliminates the need for a PBR or which reduces the likelihood of damage to a PBR and provided such an alternative arrangement. This arrangement is described in WO2011/048426 A2 and illustrated in FIGS. 2 to 5 as an alternative prior art method of providing liner tieback connection in a wellbore 100. Like features are given like reference numerals to those of FIG. 1. A tieback profile device 30 is provided at the upper end of the second tube 10 such that it has a greater diameter than the diameter of the second tube 10. The device 30 includes a number of internal recesses 32 at its internal bore. A 13⅜ in (340 mm) by 11¾ in (298 mm) liner hanger 34 is connected to the top of the device 30 and this attaches to the casing at the inner surface of the wellbore 100. The liner hanger 34, device 30 and upper portion of the second tube 10 are all configured to cross over from 13⅜ in (340 mm) to an outer diameter of 9⅝ in (244 mm). FIGS. 3 to 5 illustrate the sequence for installing the first tube 12. The first tube 12 is lowered so that its lower end is within the device 30 and lower than the internal recesses 32 of the device 30 (FIG. 4). An expandable tool 40 is then run on the lower end of a string of drillpipe down through the bore of the first tube 12 until the tool 40 is aligned with the recesses 32 of the device 30. The tool 40 includes a depth latch arrangement 42 for positioning at the correct vertical depth. The tool 40 includes a pair of seals which are vertically spaced apart by a distance greater than the vertical distance between the upper and lower recesses. The seals are actuated to form a seal between the outer surface of the tool 40 and the inner surface of the first tube 12 to define a chamber between the seals. Water is pumped through the drillstring, into the bore of the tool 40 and through apertures of the tool 40 and into the chamber. When the water pressure is sufficient, the first tube 12 expands by elastic then plastic deformation into the recesses 32. This creates a mechanical fixing and metal to metal seal between the second tube 10 and the first tube 12 via the device 30. The first tube 12 is now tied back to the surface. The seals can then be de-activated and the drill pipe string and tool 40 removed from the wellbore 100.

The improved arrangement provides a number of advantages over a conventional PBR. The metal to metal seal has sufficient resistance to the thermally generated axial loads. There is therefore little or no movement and so no wear. Also, the need for elastomeric seals is eliminated, so the device has no elastomeric material to wear out or get damaged. Also, the internal diameter of the device is not a polished seal surface and so its performance is much less affected by damage. Also, higher burst and collapse loads can be achieved.

However, while this method eliminates the need to use a PBR connection, it has a major limitation in that for certain wells the annular space between the outer casing string ID and the liner string OD too small to fit the expandable tieback connection. In a relatively narrow diameter or slim well construction, which is typical for e.g. the Caspian Sea or the Gulf of Mexico, there is very little annular space between the outer casing string and the liner. It is typical that the outer casing string has an outer diameter (OD) of 16 inches (40.6 cm) and an internal diameter (ID) of 14.6 inches (37.1 cm) and the liner string has an OD of 14 inches (35.6 cm). The annular space between the outer casing string ID and the liner string OD of 0.3 inches (0.8 cm) is too small to fit a PBR or the expandable tieback connection of WO2011/048426 A2. We consider any wellbore where the annular space is too small to fit a standard PBR as a slim hole well.

Accordingly, an object of at least one embodiment of the present invention is to provide an expandable tieback connection suitable for use in a slim well construction.

SUMMARY OF THE INVENTION

According to a first aspect of the present invention there is provided a tubular connection apparatus for use in a slim hole well, comprising:

- a plurality of casing sections, wherein at least a first casing section comprises a tubular member, the member having a profiled surface distinct from a surface of an adjacent casing section;
- a liner, wherein a portion of the liner is located within the first casing section and at least a part of the portion has been radially expanded to form a sealed joint between the liner and the first casing section.

In this way, the liner is connected directly to the casing and a PBR or an expandable tieback connection is not required. Thus by adapting the casing section to receive the liner directly, the annular space between the outer casing string ID and the liner string OD only requires to be of a tolerance to allow the liner to be run into the casing string. This provides a slim hole well construction with the maximum inner bore diameter possible for the liner.

Preferably, the profiled surface is at least a portion of an inner surface having an inner diameter smaller than an inner diameter of the adjacent casing section. Preferably also, an outer surface of the first casing section is also profiled having at least a portion with an outer diameter greater than an outer diameter of the adjacent casing section. In this way, the first casing section is profiled to provide a greater wall thickness than the adjacent casing section.

Alternatively or additionally, the profiled surface includes one or more recesses. The profiled surface may be an inner surface of the first casing section and/or an outer surface of the first casing section. In this way, the first casing section is profiled to assist in anchoring the liner to the first casing section.

Preferably, the portion of the liner is a lower end of the liner. In this way, the apparatus is a liner tieback connection.

Alternatively, the portion of the liner is an upper end of the liner. In this way, the apparatus is a liner hanger connection.

In an embodiment, there is a first liner and a second liner wherein the portion, being an upper end, of the first liner is located within the first casing section and the portion, being a lower end, of the second liner is located within the first casing section axially upwardly spaced from the first liner.

Alternatively, the apparatus includes a further liner, the further liner being hung from a lower end of the first casing section by a known method and the liner is arranged to form a liner tieback connection according to the present invention.

Preferably, the first casing section and at least the part of the portion of the liner comprise metallic portions which form a metal-to-metal sealed joint when the part is expanded against the first casing section.

Preferably, a fluid excluding material is located into the one or more recesses. In one arrangement, the fluid excluding material comprises closed cell foam, such as, for example, metal foam or syntactic foam.

Alternatively, the one or more recesses include a valve, the valve being configured to allow fluid to exit the recess when the fluid is subjected to pressure from the part of the liner expanding into the recess. In one arrangement, the valve is a one-way valve that allows fluid to escape as the pressure in the recess increases, and is sealed shut by the part of the liner once the sealed joint with the first casing section has been formed. Alternatively, the valve may be a pressure relief valve that allows the fluid to escape into an atmospheric chamber when the pressure in the recess is higher than an opening value of the valve.

In all types of casing having one or more recesses on the outer surface or the inner surface, the recess shape, depth and width are adjusted to suit the strength and weight of the casing and/or the liner being expanded into it. Furthermore, preferably, the yield stress of the first casing section is selected higher than the yield stress of the part of the portion of the liner.

Preferably, the part of the portion of the liner comprises a tubular member having a wall defining an internal bore and first and second ends, the internal bore extending between the ends and having a profiled surface.

In one such arrangement, the internal bore of the part has a greater diameter at a region intermediate the ends and the internal bore tapers from the intermediate region to the ends. Preferably in this variation, the thickness of the wall of the part increases from the intermediate region to the ends. This ensures that the part begins to expand at the intermediate region and continues to expand towards the ends causing fluid at the interface between the liner and the first casing section to be expelled as the part expands thereby preventing the occurrence of a hydraulic lock.

In another variation, the internal bore of the part is tapered from one end to the other end. Preferably, in this variation, the thickness of the wall of the part increases from one end to the other end, so that the part begins to expand at the thinner end and continues to expand towards the thicker end causing fluid at the interface between the liner and the first casing section to be expelled as the part expands.

The part may be provided with circumferential seals on the outer surface to enhance the sealing performance between the liner and the first casing section.

The apparatus may further include a wear protection tubular cover. Preferably the wear protection cover is a sleeve. Preferably the cover includes a fastening arrangement to attach the cover to an inner surface of the first casing section. The fastening arrangement may be shear pins or a spring latching mechanism. The cover may be provided with a sealing mechanism on an outer surface of the cover, i.e. the surface which in use faces the inner surface of the casing, so that, in use, the sealing mechanism is positioned between the cover and the casing to prevent well debris from entering a space between the cover and the casing and from causing the cover to become jammed in place.

According to a second aspect of the present invention there is provided a method of forming a tubular connection for use in a slim hole well, the method comprising the steps of:

a) installing a plurality of casing sections in a wellbore, wherein at least a first casing section comprises a tubular member, the member having a profiled surface distinct from a surface of an adjacent casing section;
b) setting the casing sections in the wellbore;
c) running a liner into the wellbore so that a portion of the liner is located within the first casing section; and
d) expanding at least a part of the portion of the liner radially against the first casing section at the profiled surface until a sealed joint is formed between the liner and the first casing section.

Preferably, the profiled surface is at least a portion of an inner surface having an inner diameter smaller than an inner diameter of the adjacent casing section. Preferably also, an outer surface of the first casing section is also profiled having at least a portion with an outer diameter greater than an outer diameter of the adjacent casing section. In this way, the first casing section is profiled to provide a greater wall thickness than the adjacent casing section.

Alternatively or additionally, the profiled surface includes one or more recesses. The profiled surface may be an inner surface of the first casing section and/or an outer surface of the first casing section. In this way, the first casing section is profiled to assist in anchoring the liner to the first casing section.

Preferably, in step (c) the portion of the liner is a lower end of the liner. In this way, a liner tieback connection is made.

Alternatively, in step (c) the portion of the liner is an upper end of the liner. In this way, a liner hanger connection is made.

In an embodiment, step (c) includes running a first liner into the wellbore so that a portion, being an upper end, of the first liner is located within the first casing section; and the method further includes the steps:

e) running a second liner into the wellbore so that a portion, being a lower end, of the second liner is located within the first casing section axially upwardly spaced from the first liner; and
f) expanding at least a part of the portion of the second liner radially against the casing at the profiled surface until a sealed joint is formed between the liner and the first casing section.

In this way, both a liner hanger and a tieback connection are formed on the casing section.

Alternatively, the method may include the step of hanging a first liner from a lower end of the first casing section by a known art method prior to forming a liner tieback connection with a second liner according to the present invention. The first liner may be sealed to the first casing section using a suitable sealing arrangement, such as, for example, one or more packers.

Preferably step (d) includes elastically and plastically deforming the part of the portion of the liner. Preferably also, step (d) includes elastically deforming a portion of the first casing section.

Preferably, step (d) includes radially expanding the part of the liner so that an outer diameter of the part expands from a diameter which is smaller than an internal diameter of the casing to a diameter which matches the internal diameter of the first casing section.

Preferably, step (d) includes excluding fluid from the one or more recesses arranged on the surface of the first casing section during expansion. In an embodiment the fluid may exit the recess through a valve. The method may include the step of sealing the valve with the part of the liner following expansion.

The above described methods all help to eliminate or reduce the risk of occurrence of a hydraulic lock.

Preferably the method includes the step of running a fluid expansion tool on a tubular string through a bore of the liner. The method may include the step of aligning the expansion tool with the portion of the first casing section against which the liner is expanded. The method may include using a depth latch arrangement to position the expandable tool at the correct vertical depth.

Preferably, the method includes the steps of: actuating a pair of seals of the expansion tool, the seals being spaced apart over the part of the portion of the liner; creating a sealed chamber between an outer surface of the tool and the inner surface of the liner; supplying a fluid into the chamber; apply fluid pressure against the inner surface of the part of the portion of the liner to thereby cause expansion of the part against the inner surface of the first casing section and form a sealed joint between the outer surface of part of the portion of the liner and the inner surface of the first casing section. Preferably the fluid is a high pressure liquid (e.g. pressure in excess of 20,000 psi or 138 MPa). Preferably, the part is morphed against the inner surface of the first casing section such that the part takes up the shape of the inner surface of the first casing section.

In some circumstances it is desirable to run and set the first casing section, hang a liner from the first casing section and then start drilling the next section of open hole, before tying back the liner to the wellhead. On these occasions, the portion of the inner surface of the first casing section against which the liner is expanded to form the sealed joint may remain exposed to well fluids and a rotating drill string for a considerable period of time (days or weeks) and become damaged by the drill string and the fluids. Therefore, advantageously, the method includes the step of installing a wear protection tubular cover over the inner surface of the first casing section. The method may then include the step of removing the cover prior to step (c). This may be done by using a pulling tool or a standard casing spear to release a fastening arrangement between the cover and the first casing section.

DETAILED DESCRIPTION OF THE INVENTION

Embodiments of the present invention will now be described, by way of example only, with reference to the accompanying drawings in which.

Referring to FIGS. 6 to 25, these show a method of providing a tubing connection in a slim hole wellbore 200 according to the present invention.

Figures 14, 15, 16, 17:
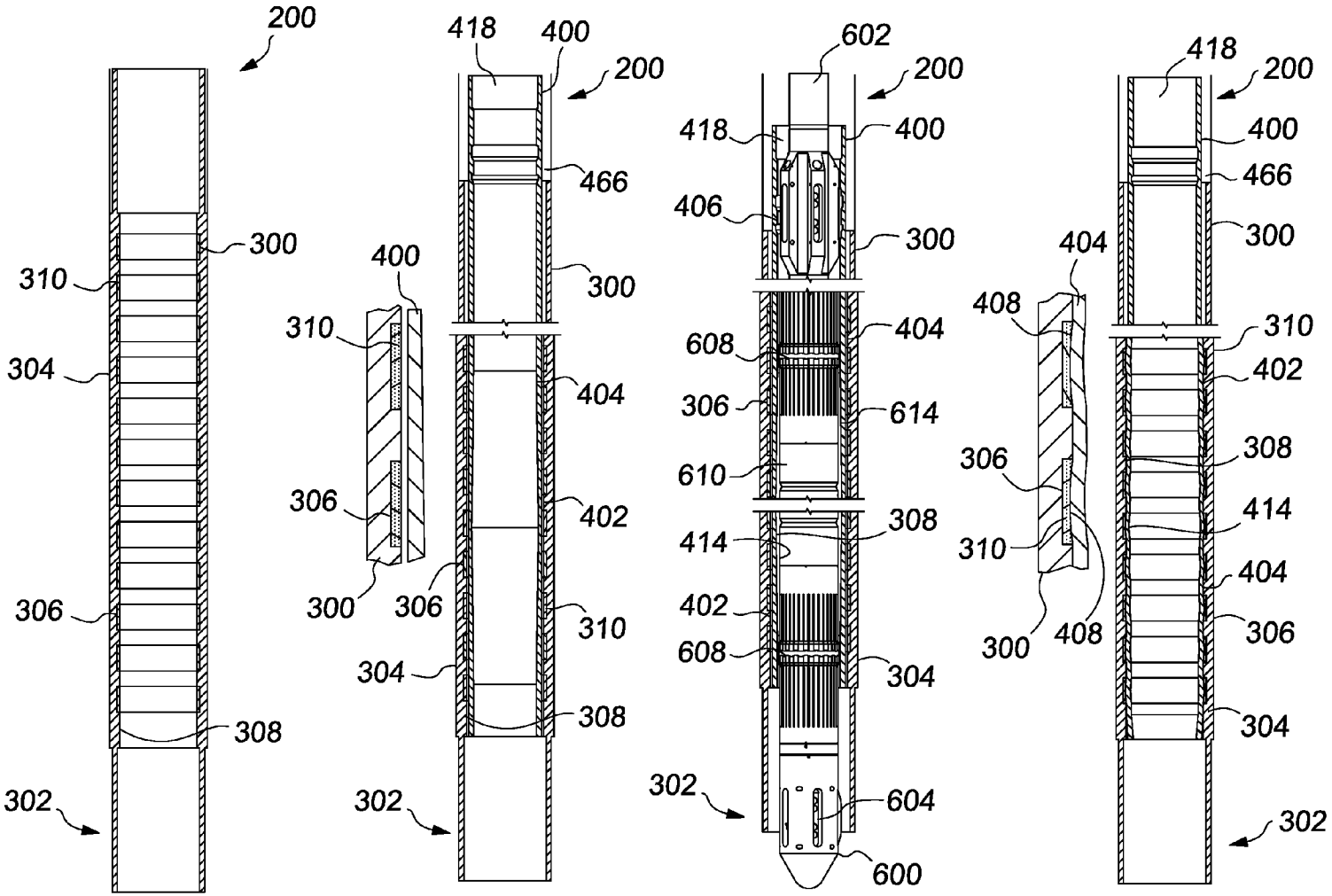
FIGS. 14 to 17 are sectional side views of stages of the method according to the present invention (making use of the embodiment of first casing section of FIG. 7)

Referring initially, to FIGS. 14 to 17, the wellbore 200 is lined with a casing 300 as shown in FIG. 14 where the casing 300 is in accordance with the present invention. Casing 300 will be arranged adjacent to other standard casing as is known in the art.

Figure 2:
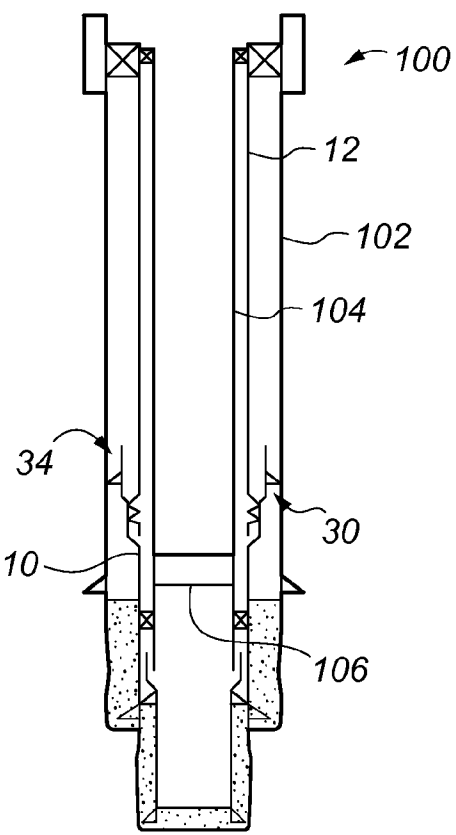
Fig. 2 (PRIOR ART)
FIG. 2 is a sectional side view of a further prior art method of providing a liner tieback connection.
Figure 1:
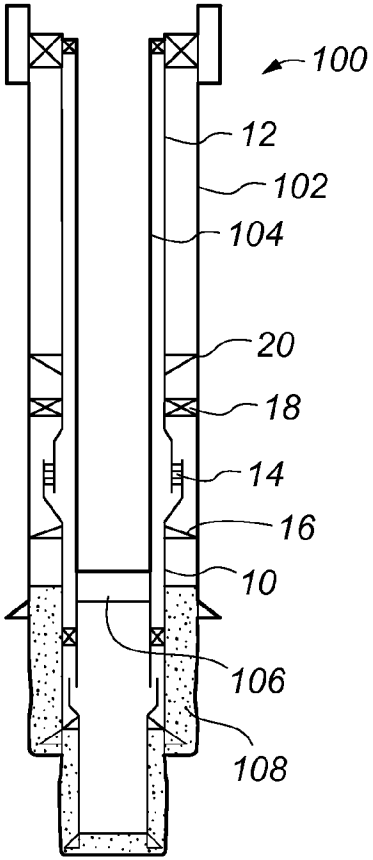
Fig. 1 (PRIOR ART)
FIG. 1 is a sectional side view of a method of providing a liner tieback connection according to the prior art.

In an embodiment, a first tubular member (not shown in the drawings), typically, a downhole liner, is hung in the wellbore 200 so that an upper end portion of the first tubular member is located about a lower end 302 of the casing 300 and overlaps with the lower end 302 of the casing 300, similar to the arrangement shown in FIG. 1. The first tubular member is sealed to the casing 300 using a suitable sealing arrangement, such as one or more packers, similar to packers 18 in FIG. 1. The next step in the method, as shown in FIG. 15, is for a second tubular member 400, typically tieback liner 400, to be run into the wellbore 200 and it is manoeuvred in the casing 300 so that a lower end 402 of the second tubular member 400 is located towards the lower end 302 of the casing 300 and above and vertically spaced from the upper end portion of the first tubular member. It should be noted that, although the method of FIGS. 14 to 17 shows the use of the embodiment of casing 300 of FIG. 7, any of the embodiments of casing 300 from FIG. 6 or FIGS. 8 to 10 can also be used.

The second tubular member 400 comprises an expandable portion 404 at the lower end 402. The expandable portion 404 is a part of the second tubular member 400. Initially, the expandable portion 404 has an outer diameter smaller than the internal diameter of the casing 300 so that the expandable portion 404 can be advanced in the casing 300 to the correct location within the casing 300. Once positioned at the correct location, the expandable portion 404 of the second tubular member 404 is deformed and expanded radially outwardly against an inner surface 308 of the casing 300 by means of an expansion tool 600 (see FIG. 16), as will be described below in more detail, until a sealed connection is formed (see FIG. 17) between an outer surface 466 of the second tubular member 400 and the inner bore of the casing 300. Upon expansion, the outer diameter of the expandable portion 404 matches the internal diameter of the casing 300. The casing 300 and the second tubular member 400 are made from metal. Thus, when the second tubular member 400 is expanded against the casing 300, a metal-to-metal sealed joint is created.

Figures 18, 19, 20, 21, 22, 23, 24, 25:
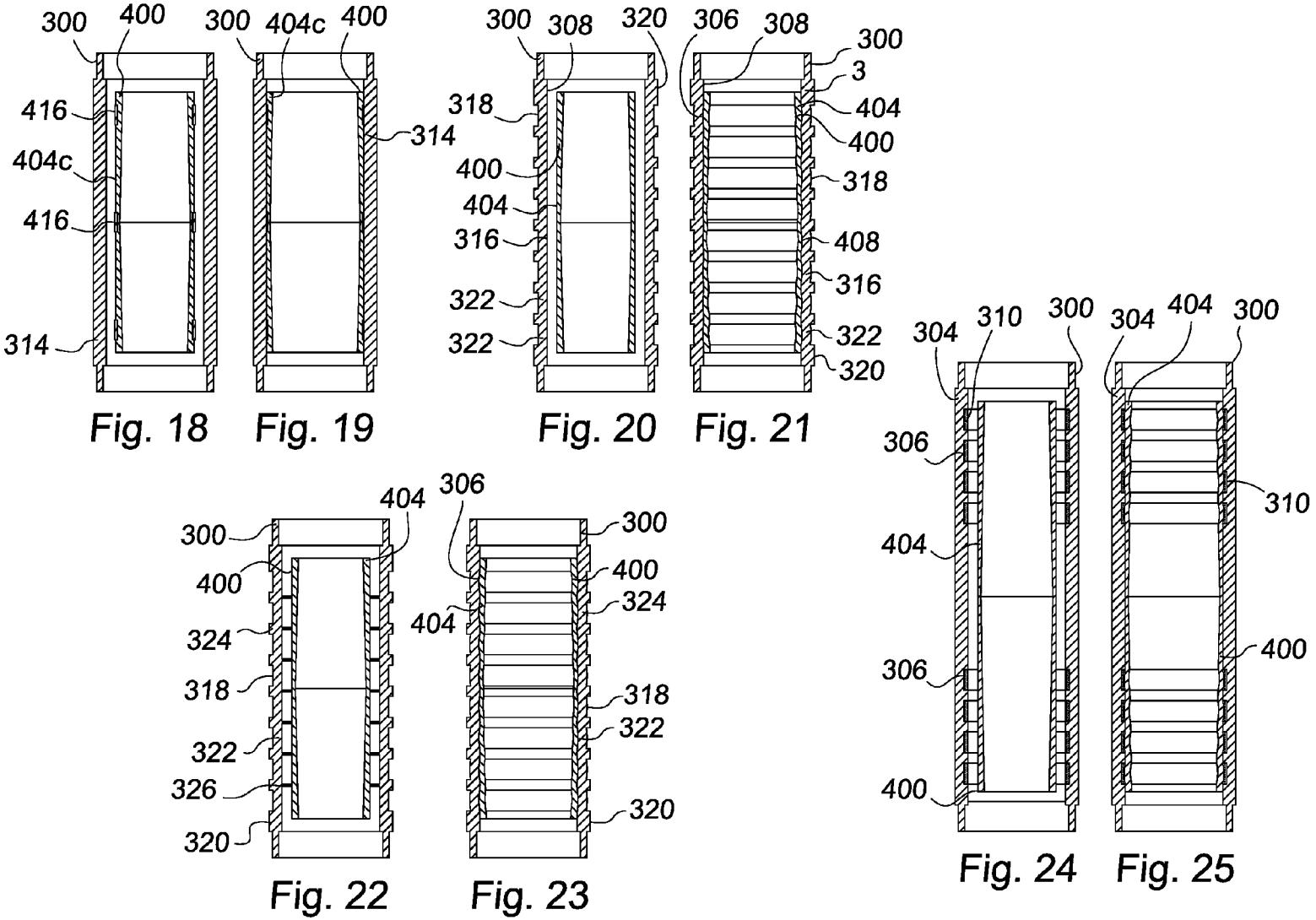
FIGS. 18 to 25 are sectional side views showing stages of connecting liner into embodiments of first casing sections used in the method according to the present invention.

As shown in FIG. 14, the first embodiment of the casing 300 comprises a profiled surface 304 having engaging elements in the form of circumferential recesses 306 (see also FIGS. 7, 10, 24 and 25) in the inner surface 308 of the casing 300. The recesses 306 are adapted to cooperate with the expandable portion 404 of the second tubular member 400 upon expansion of the expandable portion 404 to form a seal therewith. In the embodiment of FIGS. 14 to 17 the recesses 306 are provided in the form of a plurality of longitudinally spaced apart grooves formed in the inner bore of the casing 300. As shown in FIGS. 17 and 25, the expandable portion 404 of the second tubular member 400 is expanded into the recesses 306 to form circumferential protrusions 408 on the exterior of the second tubular member 400 which enter the corresponding recesses 306 to form the sealed joint with the casing 300.

In order to allow the second tubular member 400 to be expanded into the recesses 306 the recesses 306 must be fluid free. In the embodiment shown in FIGS. 14 to 17 (and also in FIGS. 7, 24 and 25), closed cell foam 310, such as, for example, metal foam or syntactic foam, is placed into the one more recesses 306. The foam 310 fills the recesses 306 before the second tubular member 400 is expanded (thereby preventing fluid from entering the recesses 306) and becomes compressed to allow the protrusions 408 to enter the recesses 306 when the second tubular member 400 is expanded. Additionally or alternatively, fluid can be removed from the recesses 306 by placing a valve 312 in or through the sidewall of the casing 300 in line with each recess 306 (see FIGS. 7 and 10). The valve 312 is configured to allow the fluid to exit the recess 306 when the fluid is subjected to pressure from the protrusions 408 of the second tubular member 400 expanding into the recess 306. The valve 312 can be, for example, a one-way valve that allows fluid to escape as the pressure in the recess increases and is sealed shut by the protrusions 408 of the second tubular member 400 once the sealed joint with the casing 300 has been formed. Alternatively, the valve 312 can be a pressure relief valve that allows the fluid to escape into an atmospheric chamber when the pressure in the recess 306 is higher than the opening value of the valve 312.

Figures 6, 7, 8, 9, 10, 11, 12, 13:
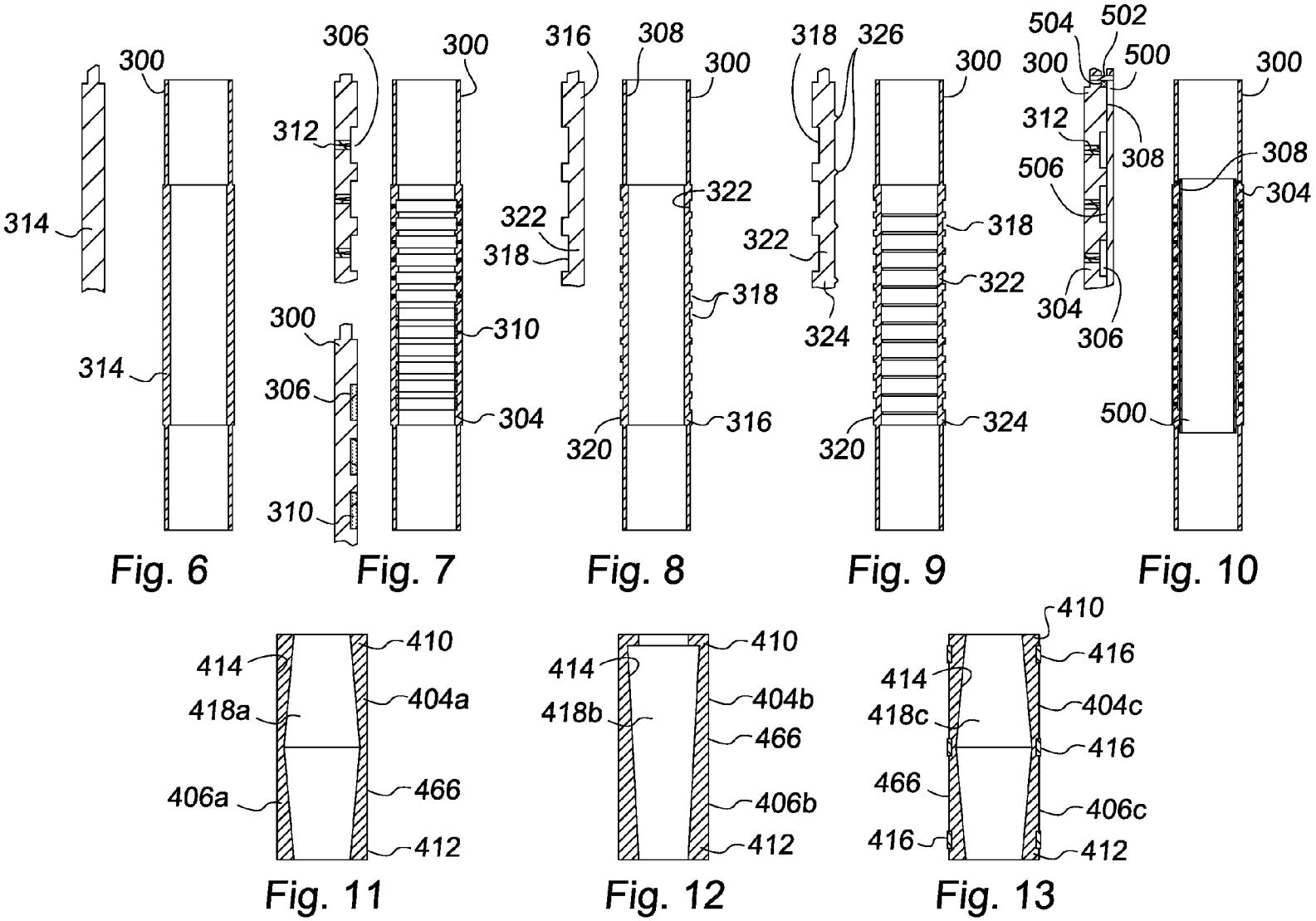
FIGS. 6 to 9 are sectional side views of a number of different embodiments of a first casing section that can be used in the method of providing a tubular connection according to the present invention.
FIG. 10 is a sectional side view showing a cover used in conjunction with the first casing section used in the method of the present invention.
FIGS. 11 to 13 are sectional side views of a part of a portion of a liner for connecting with the first casing section of FIGS. 6 to 10.

FIGS. 6 to 9 show modifications of the profiled surface of the casing 300. In FIG. 6, the casing 300 has a profiled surface 314 comprising a thickening on a tubular wall of the casing. The thickening acts as the engaging member of the profiled surface 314 when the second tubular member 400 is expanded against the thickening to form the sealed joint with the casing 300 (see also FIGS. 18 and 19). FIG. 7 shows the casing 300 that is used for illustration purposes in the method of FIGS. 14 to 17, where the upper half of the recesses 306 use a valve 312 and the lower half of the recesses use foam 310.

In a profiled surface 316 of FIG. 8, a set of recesses 318 are formed in the outer surface 320 of the casing 300 but will similarly result in the creation of circumferential protrusions 408 and also to some extent result in the creation of recesses 306 (as shown in FIG. 21) during the step of expanding the second tubular member 400 against the inner surface 308 of the casing 300 to form the sealed joint with the casing 300. As illustrated in FIGS. 8, 20 and 21, a set of recesses 318 is pre-formed in an outer surface 320 of the casing 300 thereby creating corresponding regions in the casing 300 having decreased thickness, i.e. thinnings 322. The provision of the thinnings 322 facilitates the deformation of the casing 300 by the second tubular member 400 to then in effect create the recesses 306 in the inner surface 308 of the casing 300 and simultaneously, in effect, create the circumferential protrusions 408 formed on the exterior of the second tubular member 400 thereby facilitating the formation of the sealed joint. Furthermore, providing the recesses 318 in the outer surface 320 of the casing 300 helps to eliminate or reduce the risk of occurrence of a hydrostatic lock during the expansion of the second tubular member 400.

In a profiled surface 324 of FIG. 9, like in the profiled surface 316 of FIG. 8, the recesses 318 are also formed in the outer surface 320 of the casing 300. Additionally, the inner surface 308 also has a profiled surface as profiled regions are provided in the form of inward protrusions 326 on the inner surface 308 of the casing 300. The protrusions 326 facilitate the creation of increased counteracting forces at an interface between the second tubular member 400 and the casing 300 during the expansion of the second tubular member 400 thereby facilitating the formation of an efficient sealed joint between the second tubular member 400 and the casing 300 (see also FIGS. 22 and 23).

In all types of casing 300 having one or more recesses 306, 318 on the respective inner surface 308 or the outer surface 320, the recess shape, depth and width are adjusted to suit the strength and weight of the casing 300 and/or the second tubular member 400 being expanded into the casing 300. The yield stress of the casing 300 is selected higher than the yield stress of the second tubular member 400.

In FIGS. 11 to 13, three different respective variations of the expandable portion 404 of the second tubular member 400 are illustrated each showing a profiled inner surface. In all these variations, the respective expandable portion 404*a*, 404*b*, 404*c* is provided in the form of a tubular member having a wall 406*a*, 406*b*, 406*c* defining an internal bore 418*a*, 418*b*, 418*c* extending between opposite ends 410, 412. The expandable portion 404*a*, 404*b*, 404*c* is expanded by applying radial outward force to an inner surface 414 of the expandable portion 404*a*, 404*b*, 404*c*. The expandable portion 404*a*, 404*b*, 404*c* is suitable for being expanded by way of hydraulic deformation with high pressure liquid (e.g. pressure in excess of 20,000 psi or 138 MPa) until it comes into compliant contact with the casing 300 and forms the sealed joint therewith. The expandable portion 404*a*, 404*b*, 404*c* is configured so as to optimise the sealed contact and the strength of the joint between the second tubular member 400 and the casing 300. For this purpose, in FIG. 11 the internal bore 418*a* of the expandable portion 404*a* has a greater diameter at a region centrally located between the ends 410, 412 and the internal bore 418*a* tapers from the centrally located region to the ends 410, 412 and the thickness of the wall 406*a* of the expandable portion 404*a* increases from the centrally located region to the ends 410, 412. This ensures that the expandable portion 404*a* begins to expand at the centrally located region and continues to expand towards the ends 410, 412 causing fluid at the interface between the second tubular member 400 and the casing 300 to be expelled as the expandable portion 404*a* expands thereby preventing the occurrence of a hydraulic lock therebetween. In FIG. 12, the internal bore 418*b* of the expandable portion 404*b* is tapered from one end 410, to the other end 412, whereas the thickness of the wall 406*b* of the expandable portion 404*b* increases from one end 410 to the other end 412, so that the expandable portion 404*b* begins to expand at the thinner end 410 and continues to expand towards the thicker end 412 causing the fluid at the interface between the second tubular member 400 and the casing 300 to be expelled as the expandable portion 404*b* expands radially. In FIG. 13, the expandable portion 404*c* is provided with circumferential seals 416 on the outer surface 466 to enhance the sealing performance between the second tubular member 400 and the casing 300 (see also FIGS. 18 and 19).

In some circumstances it is desirable to run and set the casing 300 and hang the first tubular member (not shown in the drawings) off the casing 300 and then start drilling the next section of open hole, before tying back the first tubular member to the wellhead. On these occasions, the inner profiled surface 304, 314, 316, 324 of the casing 300 may remain exposed to well fluids and a rotating drill string for a considerable period of time (days or weeks) and become damaged by the drill string and the fluids. For this purpose, a wear protection tubular cover is installed in the casing 300 prior to running the casing 300 into the well. FIG. 10 shows a profiled surface 304 having a wear protection cover in the form of a sleeve 500 covering the inner surface 308 of the casing 300. The sleeve 500 is secured in place by shear pins 502 and is provided with a sealing ring 504 on an outer surface 506 of the sleeve 500 which in use is sandwiched between the cover 500 and the casing 300 to prevent well debris from entering the space between the sleeve 500 and the casing 300 and from causing the sleeve 500 to become jammed in place. When the second tubular member 400 is to be run in the casing 300, the sleeve 500 is removed by using a pulling or fishing tool (not shown) or a standard casing spear (not shown) to release the shear pins 502 and remove the sleeve 500 from the well.

While the FIGS. 14 to 17 illustrate a tieback connection with the second tubular member 400 having a portion at a lower end inserted in the casing 300, it will be apparent that the second tubular member 400 could be inserted through the casing 300 so that a portion of an upper end of the second tubular member 400 is located in a lower end of the casing 300.

With all embodiments according to the present invention, since both the first tubular member and the second tubular member 400 are fixed directly to the inner surface 308 of the outer casing 300, inner and outer diameters of the first tubular member substantially correspond to the respective inner and outer diameters of the second tubular member 400.

Figure 5:
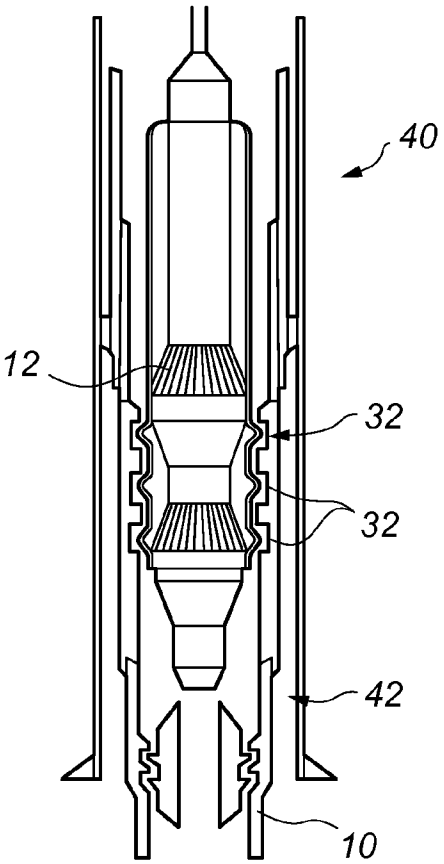
Fig. 5 (PRIOR ART)
FIGS. 3 to 5 are sectional side views of stages of the prior art method of FIG. 2.
Figure 4:
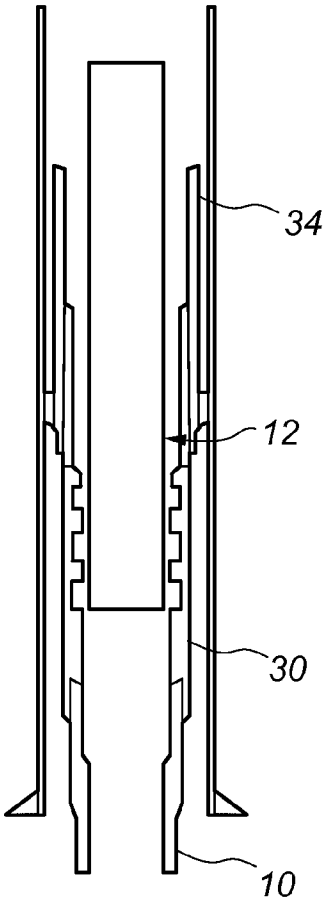
Fig. 4 (PRIOR ART)
Figure 3:
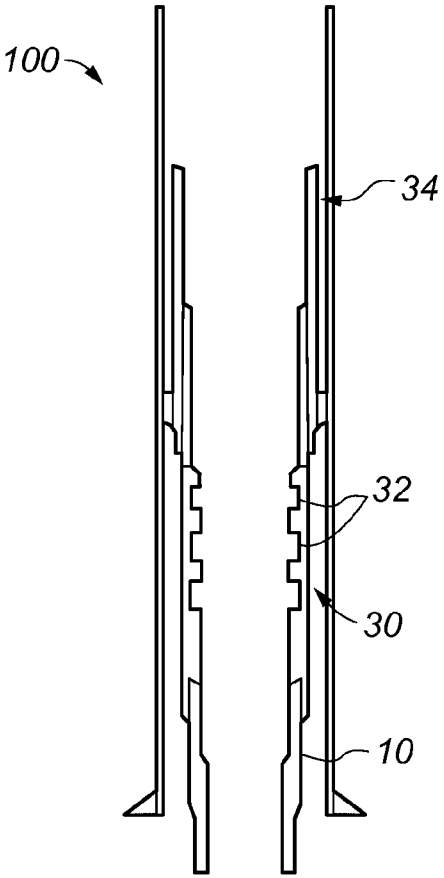
Fig. 3 (PRIOR ART)

FIG. 16 shows a fluid expansion tool 600 for expanding the second tubular member 400 in a manner similar to that described in connection with the prior art method of FIGS. 3 to 5. To do this, the expansion tool 600 is run on a drill string 602 through a bore 418 of the second tubular member 400. The expansion tool 600 is then aligned with the expandable portion 404 of the second tubular member 400 which in turn is aligned with the profiled surface 304 of the casing 300. The tool 600 includes a depth latch arrangement 604 for positioning the tool 600 at the correct vertical depth. The tool 600 includes a pair of seals 608 which are vertically spaced apart by a distance greater, the same as or less than (but preferably greater or the same as) the vertical distance between the upper and lower recesses 306 of the profiled surface 304. The seals 608 are actuated to form a seal between an outer surface 610 of the tool 600 and the inner surface 414 of the expandable portion 404 to define a chamber 614 between the seals 608. Hydraulic fluid (which could be oil or water) is then pumped through the drillstring 602, into an internal bore (not visible in the drawing) of the tool 600 and through apertures (not shown) in the tool 600 into the chamber 614. When the hydraulic fluid pressure is sufficient, the expandable portion 404 expands and thus contacts the inner surface 308 of the casing 300 and, due to the recesses 306 or 318, protrusions 408 are formed by initially elastic and then plastic deformation and the protrusions 408 expand into the recesses 306 or 318. This creates a mechanical fixing and also a metal to metal seal between the second tubular member 400 and the casing 300. The first tubular member, which is hung off the lower end 302 of the casing 300, thus becomes tied back to the surface by the second tubular member 400 via the casing 300. The seals 608 of the tool 600 can then be de-activated and the drillstring 602 and tool 600 removed from the wellbore 200.

The sealed joint according to the above-described embodiments can be formed between the casing and the second tubular member at any suitable depth, and for any suitable length, to provide the required connection. A conventional PBR is very short (e.g. 10 ft or 3 m) making correct spacing out difficult to achieve at the first attempt, whereas multiple attempts take considerable time and therefore have a significant cost. A tieback connection according the method and apparatus of an embodiment of the invention can be very long and therefore the spacing out can likely always be achieved on the first attempt; provides a greater internal bore diameter than that achieved using a conventional PBR and thus eliminates the problem of high mud pressure in the wellbore; dispenses with the need to use elastomeric seals and eliminates the problem of a PBR being prone to damage in the wellbore; and fits compactly within existing casing construction and is thus suitable for slim well construction, unlike the prior art liner tieback connections.

Thus, the method and apparatus of the invention eliminates or mitigates the problem of lack of annular space associated with providing liner hanger and tieback connections in slim wells using prior art techniques. The liner tie back connection or hanger connection of the present invention fits compactly within existing casing 300 and is thus suitable for slim well construction, unlike the prior art liner tieback and hanger connections.

Whilst specific embodiments of the present invention have been described above, it will be appreciated that modifications are possible within the scope of the present invention.

We claim:

1. A tubular connection apparatus for use in a well, comprising:

a plurality of casing sections, wherein at least a first casing section comprises a tubular member, the member having a profiled surface distinct from a surface of an adjacent casing section;

a liner, wherein a portion of the liner is located within the first casing section and at least a part of the portion has been radially expanded and directly received by the profiled surface of the tubular member to form a sealed joint between the liner and the profiled surface of said tubular member, said sealed joint preventing axial movement between said liner and said tubular member and creating a pressure seal therebetween, wherein the profiled surface comprises one or more recesses; and wherein the one or more recesses include a valve, the valve being configured to allow fluid to exit the recess when the fluid is subjected to pressure from the part of the liner expanding into the recess.

2. A tubular connection apparatus according to claim 1 wherein each recess is a circumferential groove.

3. A tubular connection apparatus for use in a well, comprising:

a plurality of casing sections, wherein at least a first casing section comprises a tubular member, the member having a profiled surface distinct from a surface of an adjacent casing section;

a liner, wherein a portion of the liner is located within the first casing section and at least a part of the portion has been radially expanded and directly received by the profiled surface of the tubular member to form a sealed joint between the liner and the profiled surface of said tubular member, said sealed joint preventing axial movement between said liner and said tubular member and creating a pressure seal therebetween, wherein the part of the portion of the liner comprises a tubular member having a wall defining an internal bore and first and second ends, the internal bore extending between the ends and having an inner profiled surface, wherein the inner profiled surface is tapered from one end to the other end.

4. A tubular connection apparatus according to claim 3 wherein an inner surface of the first casing section is profiled.

5. A tubular connection apparatus according to claim 3 wherein an outer surface of the first casing section is profiled.

6. A tubular connection apparatus according to claim 3 wherein the profiled surface is a raised surface on at least a portion of an inner surface and an outer surface of the first casing section providing a wall thickness which is greater than a wall thickness of the adjacent casing section.

7. A tubular connection apparatus according to claim 3 wherein the profiled surface comprises one or more recesses and wherein a fluid excluding material is located into the one or more recesses.

8. A tubular connection apparatus according to claim 7 wherein the fluid excluding material comprises a closed cell foam.

9. A tubular connection apparatus for use in a well, comprising:

a plurality of casing sections, wherein at least a first casing section comprises a tubular member, the member having a profiled surface distinct from a surface of an adjacent casing section;

a liner, wherein a portion of the liner is located within the first casing section and at least a part of the portion has been radially expanded and directly received by the profiled surface of the tubular member to form a sealed joint between the liner and the profiled surface of said tubular member, said sealed joint preventing axial movement between said liner and said tubular member and creating a pressure seal therebetween, wherein the part of the portion of the liner comprises a tubular member having a wall defining an internal bore and first and second ends, the internal bore extending between the ends and having an inner profiled surface, wherein the inner profiled surface is tapered from an intermediate region to the ends so the internal bore of the part has a greater diameter at the intermediate region.

10. A tubular connection apparatus according to claim 9 wherein an inner surface of the first casing section is profiled.

11. A tubular connection apparatus according to claim 9 wherein an outer surface of the first casing section is profiled.

12. A tubular connection apparatus according to claim 9 wherein the profiled surface is a raised surface on at least a portion of an inner surface and an outer surface of the first casing section providing a wall thickness which is greater than a wall thickness of the adjacent casing section.

13. A tubular connection apparatus according to claim 9 wherein the profiled surface comprises one or more recesses and wherein a fluid excluding material is located into the one or more recesses.

14. A tubular connection apparatus according to claim 13 wherein the fluid excluding material comprises a closed cell foam.

15. A tubular connection apparatus for use in a well, comprising:

a plurality of casing sections, wherein at least a first casing section comprises a tubular member, the member having a profiled surface distinct from a surface of an adjacent casing section;

a liner, wherein a portion of the liner is located within the first casing section and at least a part of the portion has been radially expanded and directly received by the profiled surface of the tubular member to form a sealed joint between the liner and the profiled surface of said tubular member, said sealed joint preventing axial movement between said liner and said tubular member and creating a pressure seal therebetween, wherein the apparatus further includes a wear protection tubular cover adapted to locate over at least a portion of the inner surface of the first casing section, and wherein the cover includes a fastening arrangement to attach the cover to the inner surface of the first casing section.

16. A method of forming a tubular connection for use in a well, the method comprising the steps of:

a. installing a plurality of casing sections in a wellbore, wherein at least a first casing section comprises a tubular member, the member having a profiled surface distinct from a surface of an adjacent casing section;

b. setting the casing sections in the wellbore;

c. running a liner into the wellbore so that a portion of the liner is located within the first casing section; and d. expanding at least a part of the portion of the liner radially against the first casing section at the profiled surface and excluding fluid from one or more recesses forming the profiled surface of the first casing section, through a valve during expansion, said first casing section directly receiving said expanded portion of said liner, until a sealed joint is formed between the liner and the first casing section, said sealed joint preventing axial movement between said liner and said first casing section and creating a pressure seal therebetween.

17. A method according to claim 16 wherein step (d) includes elastically and plastically deforming the part of the portion of the liner so that the part is morphed against the inner surface of the first casing section.

18. A method according to claim 16 wherein the method includes the step of running a fluid expansion tool on a tubular string through a bore of the liner; aligning the expansion tool with the portion of the first casing section against which the liner is to be expanded; actuating a pair of seals of the expansion tool, the seals being spaced apart over the part of the portion of the liner; creating a sealed chamber between an outer surface of the tool and the inner surface of the liner; supplying a fluid into the chamber; apply fluid pressure against the inner surface of the part of the portion of the liner to thereby cause expansion of the part against the inner surface of the first casing section and form a sealed joint between the outer surface of part of the portion of the liner and the inner surface of the first casing section.

19. A method of forming a tubular connection for use in a well, the method comprising the steps of:

a) installing a plurality of casing sections in a wellbore, wherein at least a first casing section comprises a tubular member, the member having a profiled surface distinct from a surface of an adjacent casing section;

b) setting the casing sections in the wellbore;

c) installing a wear protection tubular cover over the inner surface of the first casing section and removing the cover, and running a liner into the wellbore so that a portion of the liner is located within the first casing section; and d) expanding at least a part of the portion of the liner radially against the first casing section at the profiled surface, said first casing section directly receiving said expanded portion of said liner, until a sealed joint is formed between the liner and the first casing section, said sealed joint preventing axial movement between said liner and said first casing section and creating a pressure seal therebetween.

* * * * *